US005371928A

United States Patent [19]

Dilo

[11] Patent Number: 5,371,928

[45] Date of Patent: Dec. 13, 1994

[54] APPARATUS FOR FEEDING A FIBER BATT TO A NEEDLE LOOM

[75] Inventor: Johann P. Dilo, Eberbach, Germany

[73] Assignee: Oskar Dilo Maschinenfabrik KG, Eberbach/Neckar, Germany

[21] Appl. No.: 111,278

[22] Filed: Aug. 24, 1993

Related U.S. Application Data

[63] Continuation-in-part of Ser. No. 925,510, Aug. 4, 1992, Pat. No. 5,307,546.

[51] Int. Cl.[5] ..... D04H 18/00

[52] U.S. Cl. ..... 28/107; 28/112; 271/272

[58] Field of Search ..... 28/107, 110, 115, 114, 28/111, 112, 109; 26/18.6; 271/264, 272, 198, 8.1, 7; 226/200

[56] References Cited

U.S. PATENT DOCUMENTS

| | | | |
|---|---|---|---|
| 1,770,252 | 7/1930 | Robertson et al. | 28/107 |
| 2,177,604 | 10/1939 | Stone | 28/107 |
| 3,540,096 | 11/1970 | Porta | 28/110 |
| 3,621,540 | 11/1971 | Morrill | 28/107 |
| 3,837,054 | 9/1974 | Fehrer | 28/107 |
| 3,921,266 | 11/1975 | Fehrer | 28/4 |
| 4,042,655 | 8/1977 | Platt et al. | 28/107 |
| 4,187,586 | 2/1980 | Semjonow | 28/107 |

FOREIGN PATENT DOCUMENTS

| | | |
|---|---|---|
| 0388072 | 3/1990 | European Pat. Off. . |
| 2081737 | 2/1971 | France . |
| 2053863 | 5/1971 | Germany . |
| 2945872 | 11/1979 | Germany . |

*Primary Examiner*—Clifford D. Crowder
*Assistant Examiner*—Amy B. Vanatta
*Attorney, Agent, or Firm*—Rosen, Dainow & Jacobs

[57] ABSTRACT

Apparatus for feeding a fiber batt to a needle loom, in which a gusset gap between an upper reversing roller of a pre-compression means and an upper supply roller is filled by an upper slim transmission roller rotatably suspended at its end portions by bracket means. The transmission roller is made from a carbon fiber reinforced resin material. The bracket means are composed each of two parts which may be released from each other. One part of each bracket means is mounted on the axis of the supply roller, whereas the other part is suspended in a stationary frame of the apparatus. By realeasing the parts of each other, an easy disassembly of the supply roller is enabled.

5 Claims, 3 Drawing Sheets

APPARATUS FOR FEEDING A FIBER BATT TO A NEEDLE LOOM

RELATED PATENT APPLICATION

This patent application is a continuation-in-part of my patent application, Ser. No. 07/925,510 filed with the USPTO on Aug. 4, 1992 and now U.S. Pat. No. 5,307,546.

FIELD OF THE INVENTION

The invention relates to an apparatus for feeding a fiber batt to a needle loom.

BACKGROUND OF THE INVENTION

Such feed devices for needle looms are to feed a batt of staple fibers or endless fibers coming from a batt laying device in a possibly draft-reduced manner to the first needle row of a needle loom for the subsequent needling operation. Drafts have harmful effects on the batt uniformity and thus on the batt quality. Each draft increases the variation in the mass distribution within the batt. Thick areas remain thick, thin areas are drawn even thinner.

A well known batt feed apparatus consists of an endless base conveyor band, by which the fiber batt is supported, an endless pre-compression conveyor band arranged above the base conveyor band and approaching same in downstream direction and two so-called finger rollers, i.e. supply rollers arranged downstream of said bands and having a plurality of circumferential grooves distributed in longitudinal direction of the rollers, in which resilient rings from plastic material are slidably arranged at which fingers are formed, which extend in tangential direction of the rings in the direction towards the needle loom and thus bridge over the gusset gaps between the roller nip of the pair of finger rollers and the needle loom, more precisely the holding-down appliance of the needle loom and the needle board of the needle loom, so that the fiber batt slides through these fingers in a compressed condition without suffering considerable drafts. A similar gusset gap bridge-over formed by wires which extend through circumferential grooves in the supply rollers is disclosed in U.S. Pat. No. 3,621,540.

These devices for feeding a fiber batt, however, have the disadvantage, that between the pre-compression device, which is usually formed of said two approaching endless conveyor bands, which are running over reversing rollers, as described above, and the finger rollers, upper and lower gusset gaps remain which have an essentially triangular cross-section and which are not bridged-over and into which the bulky fiber batt bulges in and thereby affect the fiber batt advance to the needle loom. The fiber batt elastically widened into said gusset gaps must be drawn out of them, which results in the known adverse drafts.

To overcome this situation, it is already known to bridge-over the lower gusset gap between the base conveyor band running around a respective reversing roller, and the lower finger roller, by a transmission roller of a smaller diameter which is disposed in said lower gusset gap and essentially fills it. This transmission roller simply leans on the base conveyor band and the lower finger roller under friction and is supported thereby at its total length, so that it cannot bend through. Said transmission roller is preferably driven individually, in order to release the fiber batt from the base conveyor band on its path from the base conveyor band to the lower finger roller and to transmit it to the latter. My co-pending patent application mentioned above offers a solution for bridging-over the upper gusset gap between the pre-compression conveyor band and the upper finger roller.

SUMMARY OF THE INVENTION

It is the object of the invention to provide a feed apparatus of the aforementioned kind in which the upper gusset gap is bridged-over in a manner that no bulge of the batt occurs which could affect the batt feed, and in which the upper supply roller, whether being formed as a finger roller or not, may easily be removed for replacement or maintenance purposes.

According to the invention an apparatus for supplying a fiber batt in a feed direction to a needle loom is provided, comprising a pre-compression means including a batt support means, an endless continuously rotating pre-compression conveyor band arranged above the batt support means, a reversing roller at a downstream end of the pre-compression means for moving the pre-compression conveyor band in feed direction of the fiber batt, a lower supply roller and an upper supply roller mounted above the lower supply roller, said supply rollers forming a nip and being located between the downstream end of the pre-compression means and an intake of a needle loom, with the upper supply roller being proximal to said reversing roller, so that a gusset gap of approximately triangular cross-section is formed between said pre-compression conveyor band guided around the reversing roller and the upper supply roller, a transmission roller of a very stiff material disposed in said gusset gap and having a low surface friction, the circumference of said transmission roller being proximal to the surface of the pre-compression conveyor band and the upper supply roller or at least contacting one of said pre-compression conveyor band and upper supply roller, bearing means disposed at both ends of said transmission roller and supported each by bracket means mounted each by rotational bearing means on a shaft of said upper supply roller, and means for driving said transmission roller in the direction in which the upper reversing roller and the upper supply roller are driven, said bracket means being each composed of two parts releasably affixed to each other and of which one part is mounted by said rotational bearing on said shaft of said upper supply roller whereas the other part mounts said transmission roller and is in turn engaged by a holding means mounted to a frame of said apparatus.

The invention makes use of the idea already known from the bridge-over of the lower gusset gap to essentially fill said gap by means of a transmission roller. While, however, in respect to the support of the lower transmission roller no problems arise, since it is supported in its entire length by the lower finger roller and the base conveyor band situated on the lower reversing roller, the problem occurs in respect to a transmission roller arranged in the upper gusset gap, in that this roller, due to its slim shape, is tending to sag, which can be quite considerable.

The invention provides a solution by a special selection of the material from which said upper transmission roller is manufactured. The upper transmission roller is preferably made of a resin material which is reinforced by carbon fibers. Thereby, the weight of said transmission roller is reduced, and at the same time its stiffness is improved so as to prevent sagging of the transmission roller.

As the upper supply roller needs maintenance and is sometimes to be replaced, easy mounting and dismounting of the upper supply roller is imperative. The design of the mounting of said upper transmission roller enables a simple and quick removal of the upper supply roller without any need for a removal of said the transmission roller.

According to the invention, the upper transmission roller comprises rotational bearings, preferably roller bearings, at both of its ends, said bearings having outer bearing bushes which are supported each by a bracket composed of two parts which may be disassembled to get easy access to the upper supply roller for the removal thereof, which may be necessary for maintenance purposes.

The upper supply roller may generally be formed as a finger roller, as already explained, having guide fingers extending from rings which are located in circumferential grooves formed in mutual spacings in the circumference of the roller. Such rings may have a somewhat larger outer diameter than the roller supporting them, so that the upper transmission roller does not contact the surface of the finger roller but said rings. The positive effect of this design is a reduction of the friction at the surface of the upper transmission roller. Such friction may further be reduced if said rings are made from a plastic material having a low friction coefficient, as already described.

BRIEF DESCRIPTION OF THE DRAWINGS

The invention will now be explained with reference to the embodiments shown in the drawings wherein.

DETAILED DESCRIPTION OF THE INVENTION

Figure 1:
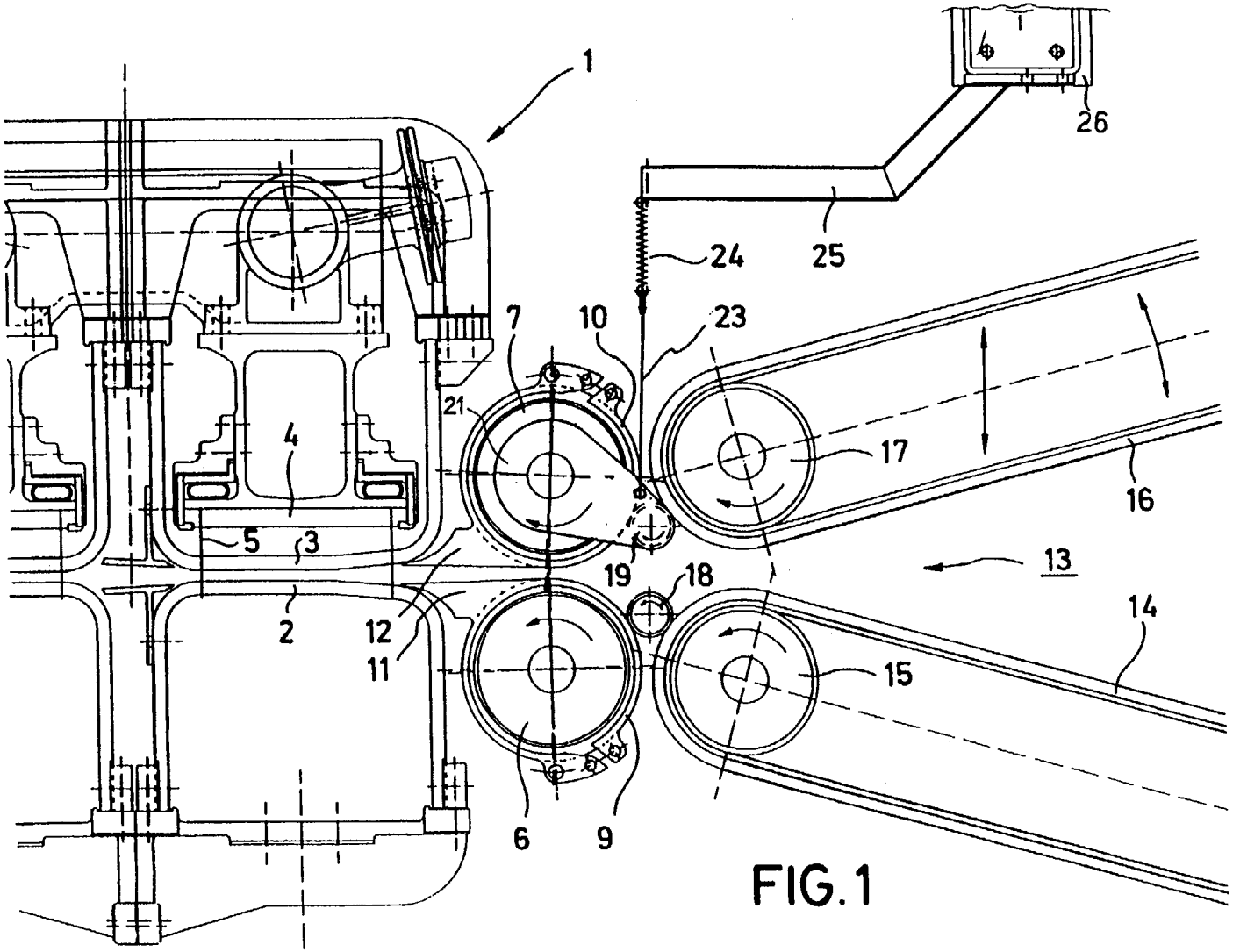
FIG. 1 is a schematic side view of the intake area of a needle loom with the downstream end of a pre-compression means and a pair of finger rollers and with two transmission rollers in the gusset gaps between the pre-compression means and the finger rollers.

In FIG. 1 the intake area of a needle loom 1 with a perforated needle plate 2, a holding down appliance 3 and a needle bar 4 able to move up and down can be seen, to which a plurality of needles 5 are attached, with only two being shown in the example for reasons of simplification. On the intake side of the needle loom 1, two supply rollers are arranged, i.e. a lower supply roller 6 and an upper supply roller 7. They are formed as so-called finger rollers, i.e. they have a plurality of grooves 8, formed at regular spacings in the longitudinal direction to their circumference (FIG. 3) in each of which an open, resilient ring 9 and 10, respectively, is loosely located. Said rings 9 and 10 consist of a low friction plastic material, on which a finger 11 and 12, respectively, is formed which extends in the tangential direction away from the ring 9 and 10, respectively, in the direction towards the intake of the needle loom 1 between the needle plate 2 and the holding down appliance 3.

In the direction towards the pair of finger rollers 6, 7 there is a pre-compression means generally characterized by the numeral 13, consisting of a lower base conveyor band 14, which runs over a lower reversing roller 15 at the downstream end of the pre-compression means, and of an upper pre-compression conveyor band 16, which runs over an upper reversing roller 17 disposed opposite the lower reversing roller 15. In the gusset gap having an essentially triangular cross section and formed between the base conveyor band 14 and the lower finger roller 6 a lower transmission roller 18 is disposed which is driven in the same direction as the base conveyor band 14 and the lower finger roller 6, e.g. via a chain drive, which drivingly connects the lower finger roller 6 with the lower transmission roller 18.

This construction is known so far.

Figure 3:
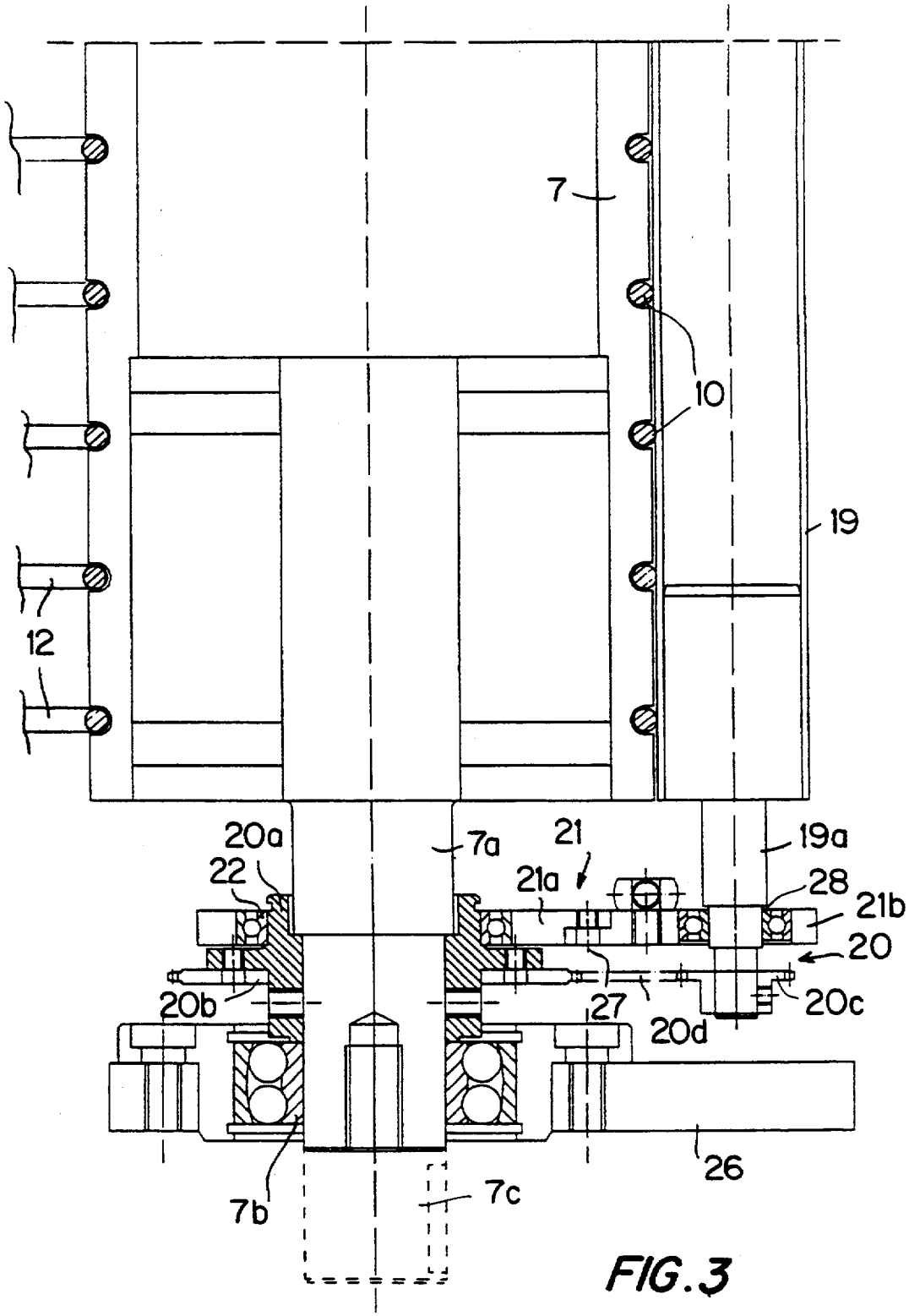
FIG. 3 is a schematic top view of one end of the upper finger roller and the upper transmission roller and shows the lateral support of the upper transmission roller and at the same time the drive for same.

In the upper gusset gap, which is formed between the pre-compression conveyor band 16 at the upper reversing roller 17 and the upper finger roller 7, an upper transmission roller 19 is disposed which is driven in the same direction as the pre-compression conveyor band 16 and the associated finger roller 7. As is shown in FIG. 3 depicting one end portion of the upper finger roller 7 and of the upper transmission roller 19, the upper finger roller 7 comprises a shaft *7a* affixed to the end portion of said finger roller 7 and rotationally supported by a ball bearing *7b* in a machine frame 26, part of which is shown in FIG. 3. The upper finger roller 7 is rotated by drive means (not shown) which may operatively be connected to an axial extension *7c* of the end portion of the shaft *7a*, see e.g. the dash-dotted lines in FIG. 3.

The drive of the upper transmission roller 19 is preferably carried out via a chain drive 20 by the upper finger roller 7, said chain drive 20 connecting the latter drivingly with the upper transmission roller 19, see FIG. 3. In order to enable a certain radial movability of the upper transmission roller 19, which is necessary to adjust the distance to the base conveyor band 14 by lowering the pre-compression band 16, the upper transmission roller 19 is rotatably supported at its ends in a pair of brackets 21, one of which being shown in the drawing, which are in turn supported via rotary bearing means 22 (FIG. 3) on the shaft *7a* of the upper finger roller 7.

Figure 2:
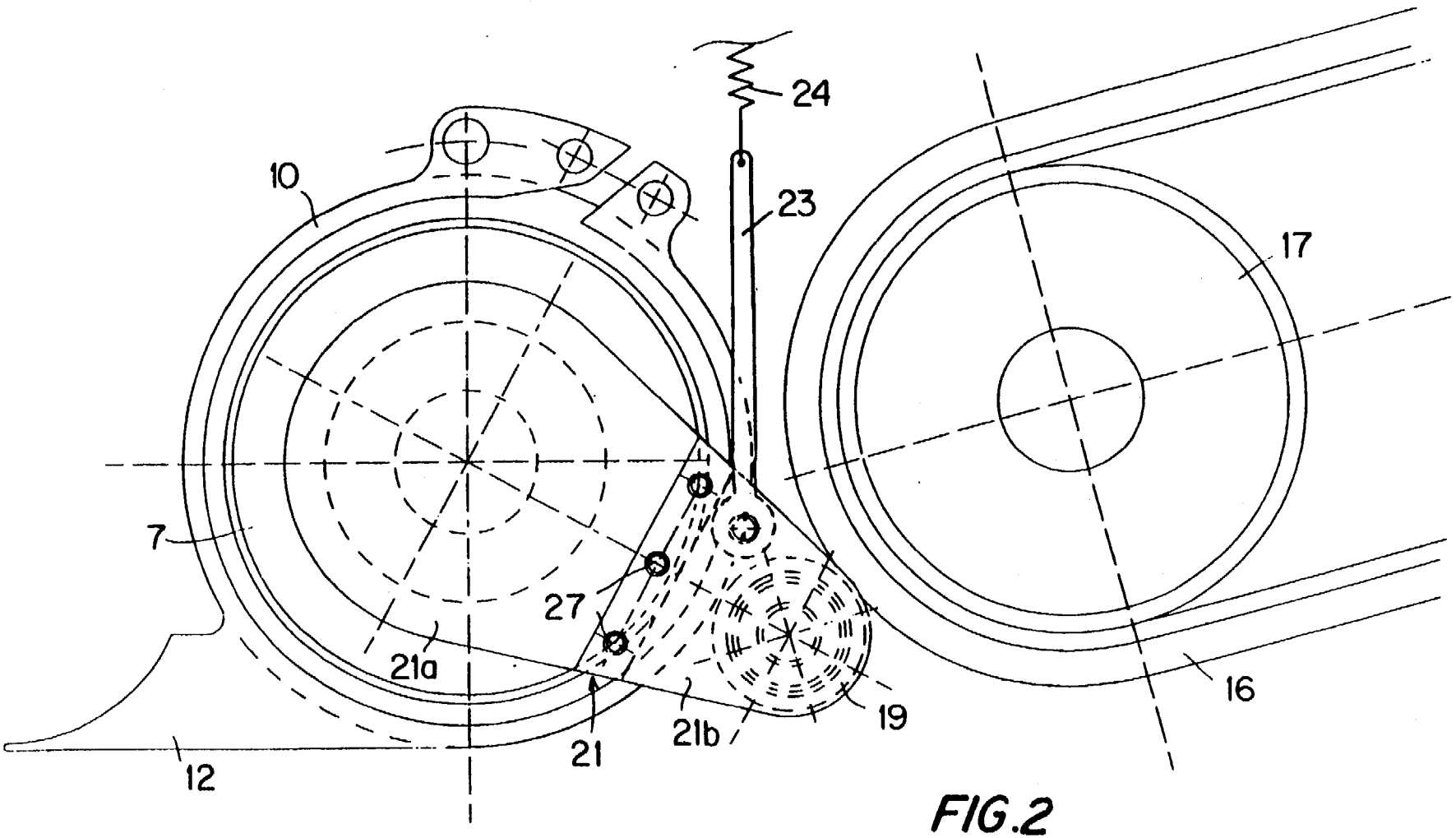
FIG. 2 is a radial sectional view of a section of FIG. 1 and shows details of an embodiment of the suspension of the upper transmission roller.

In the embodiment according to FIG. 1, a section of which is shown in enlarged scale in FIG. 2, the brackets 21 supporting the upper transmission roller 19 are suspended by suspension means 23, e.g. bars, strips or wires, affixed at one of their ends to the brackets 21 and suspended at their other ends by spring means 24 affixed to a carrier 25 fixedly connected to the a frame 26 (partially shown) of the apparatus. The spring means 24 maintain the upper transmission roller 19 in contact with the pre-compression conveyor band 16 or the upper finger roller 7 or both or with the rings 10, where applicable, as explained below, and at the same time enable a vertical movement of the transmission roller 19 in case it is necessary to adjust the height of the upper reversing roller 17.

The surface of the upper transmission roller 19 is preferably friction-reduced, it may be a polished or plastic-coated roller, with polyethylene and polytetrafluorethylene being especially advantageous as coating materials.

In the embodiment of FIG. 3, the upper transmission roller 19 contacts the rings 10 at which the fingers 12 are formed, as these rings 10 have a larger outer diameter than the roller 7 supporting same, so that relatively small areas of contact of said transmission roller 19 result therefrom. Since the rings 10 consist of a material of reduced friction, the frictional effects are small.

The drive of the upper transmission roller 19 can be carried out via a chain drive 20, as shown in FIG. 3 and explained below.

The upper transmission roller 19 has a diameter which is sufficiently large to fill the gusset gap to the largest possible extent. It is preferably dimensioned so that a lowest location on the circumference of the upper transmission roller 19 is located at least approximately in a line which tangentially connects the lower portion of the circumference of the upper finger roller 7 with the pre-compression conveyor band 16 surrounding the upper reversing roller 17, but preferably is disposed somewhat beneath this line. The diameter of the upper transmission roller 19 may preferably be approximately ¼ of the diameter of the upper finger roller 7.

As is shown in FIGS. 2 and 3, each bracket 21 comprises two bracket parts 21*a* and 21*b*, releasably connected with each other by bolts 27 or the like. In the drawing, one end portion of the upper finger roller 7 and of the upper transmission roller 19 is shown so that one bracket 21 only is shown. The other end portion of said rollers and the other bracket are designed symmetrically thereto, so that a detailed explanation thereof may be omitted.

Bracket part 21*a* is mounted to the flange 20*a* of a sprocket 20*b* via roller bearing 22. Said sprocket 20*b* being affixed to the shaft 7*a* of the upper finger roller 7, the bracket 21 may be pivoted around said shaft 7*a* to adjust the position of the upper transmission roller 19. Bracket part 21*b* releasably connected to bracket part 21*a* is provided with a roller bearing 28 in which a shaft 19*a* of the upper transmission roller 19 is rotatably mounted. To the end of said shaft 19*a* a sprocket 20*c* is affixed, and an endless chain 20*d* interconnects sprocket 20*b* and sprocket 20*c* so that the upper transmission roller 19 is rotated by the rotation of the upper finger roller 7 in the same rotational direction as said finger roller 7.

The suspension means 23 suspending the bracket 21 are affixed to bracket part 21*b*. Thus, upon removing bolts 27 fixing bracket part 21*b* to bracket part 21*a*, and removing chain 20*d*, the upper finger roller 7 may be dismounted from the apparatus independently of the upper transmission roller 19 which remains supported by the suspension means 23.

I claim:

1. An apparatus for supplying a fiber batt in a feed direction to a needle loom, comprising a pre-compression means including a batt support means, an endless continuously rotating pre-compression conveyor band arranged above the batt support means, a reversing roller at a downstream end of the pre-compression means for moving the pre-compression conveyor band in feed direction of the fiber batt, a lower supply roller and an upper supply roller mounted above the lower supply roller, said supply rollers forming a nip and being located between the downstream end of the pre-compression means and an intake of the needle loom, with the upper supply roller being proximal to said reversing roller, so that a gusset gap of approximately triangular cross-section is formed between said pre-compression conveyor band guided around the reversing roller and the upper supply roller, a transmission roller of a very stiff material disposed in said gusset gap and having a low surface friction, the circumference of said transmission roller being proximal to the surface of the pre-compression conveyor band and the upper supply roller or at least contacting one of said pre-compression conveyor band and upper supply roller, bearing means disposed at both ends of said transmission roller and supported each by bracket means mounted each by rotational bearing means on a shaft of said upper supply roller, and means for driving said transmission roller in the direction in which the upper reversing roller and the upper supply roller are driven, said bracket means being each composed of two parts releasably affixed to each other and of which one part is mounted by said rotational bearing on said shaft of said upper supply roller whereas the other part rotatably mounts said transmission roller and is in turn engaged by a holding means mounted to a frame of said apparatus.

2. An apparatus according to claim 1 wherein the transmission roller is made from a carbon fiber reinforced resin material.

3. An apparatus according to claim 1 wherein a lowest tangent to the circumference of the transmission roller is approximately at the level of a connection line which forms a common tangent of the pre-compression conveyor band at the upper reversing roller and the upper supply roller.

4. An apparatus according to claim 3 wherein the diameter of the transmission roller is approximately ¼ of the diameter the upper supply roller.

5. An apparatus according to any one of the preceding claims wherein the upper supply roller is a finger roller having a plurality of circumferential grooves distributed along its length, an open ring in each said groove, each said open ring having a guide finger extending tangentially in a direction towards the .needle loom, said guide fingers bridging over a second gusset gap between the upper supply roller and the needle loom, the rings each having an outer diameter which is slightly larger than that of the upper supply roller, the transmission roller contacting the rings.

* * * * *